United States Patent [19]
Child
[11] 4,442,780
[45] Apr. 17, 1984

[54] CLIPBOARD AND SHIELD

[75] Inventor: Francis W. Child, Eagle Bend, Minn.

[73] Assignee: Child Laboratories Inc., Cody, Wyo.

[21] Appl. No.: 170,732

[22] Filed: Jul. 21, 1980

[51] Int. Cl.[3] ..... F41H 5/08

[52] U.S. Cl. ..... 109/29; 24/67.7; 24/67.11; 89/36 D; 109/80; D7/38; D7/410

[58] Field of Search ..... 109/29, 44, 49.5, 80; 281/45; 24/67.7, 67.11, 67.5; 428/911, 252; 89/36 R, 36 A, 36 D; D7/38, 88

[56] References Cited

U.S. PATENT DOCUMENTS

| | | | |
|---|---|---|---|
| D. 27,278 | 6/1897 | Coles | D7/88 |
| D. 148,455 | 1/1948 | Bleich | D7/38 |
| D. 170,679 | 10/1953 | Del Mas | D7/38 |
| D. 182,577 | 4/1958 | Fleming | D19/88 |
| 1,398,592 | 11/1921 | Hohnsbeen | 24/67.5 |
| 2,996,774 | 8/1961 | Sutton | 24/66 |
| 3,516,898 | 6/1970 | Cook | 428/911 |
| 3,523,057 | 8/1970 | Buck | 109/49.5 |
| 3,577,306 | 5/1971 | Baker | 109/80 |
| 3,722,355 | 3/1973 | King | 428/911 |
| 3,745,938 | 7/1973 | Hathaway | 109/49.5 |
| 3,766,865 | 10/1973 | Cutler | 109/49.5 |
| 3,848,547 | 11/1974 | Schaefer | 109/49.5 |
| 3,866,242 | 2/1975 | Slagel | 2/2.5 |
| 4,109,543 | 8/1978 | Foti | 428/252 |

OTHER PUBLICATIONS

Brochure–*The Posse Box,* Posse Police Products, Inc., P.O. Box 4605, Carson, California 90749.

Newspaper Article–"Drivers License Exam Station," *Minneapolis Tribune.*

*Primary Examiner*—Reinaldo P. Machado
*Attorney, Agent, or Firm*—Burd, Bartz & Gutenkauf

[57] ABSTRACT

A clipboard and shield apparatus having a board with a top flat surface to accommodate writing paper and a bottom with ribs forming pockets which serve as barriers to prevent a sharp object from moving off the apparatus. The board has high impact strength provided by laminated sheet members bonded together and surrounding a high strength core comprising a woven mat of high density polyethylene. A hand grip is attached to one side of the board. A fluid dispenser or flashlight is carried by the hand grip.

38 Claims, 8 Drawing Figures

CLIPBOARD AND SHIELD

SUMMARY OF THE INVENTION

Clipboards conventinally have a writing surface and a clip at the top thereof to hold one or more sheets of paper on the writing surface. The clipboards are one-piece members made out of wood, hardboard, plastic, or metal. They function as portable table units having writing surfaces that provide a solid base to facilitate the use of writing instruments to place information on paper. Examples of clipboards are shown in U.S. Pat. Nos. 1,398,592 and 2,996,774.

The apparatus of the invention is a clipboard having side-by-side sheet members that are adhesively bonded together to provide a strong lightweight laminated structure. The sheet members surround a core comprising a mat of high strength plastic cords that are woven together. The core has a high impact and tear strength sufficient to absorb the impact energy of a rapidly moving projectile, such as the bullets fired from a rifle or a hand gun. The sheet members are high impact material, as high density polyethylene, capable of withstanding high impact forces. The top sheet member of the board has a generally flat outside surface providing a first side of the board for accommodating the sheet means, as paper. A clip attached to the board functions to hold the sheet means on the surface. The opposite or back side of the board has a plurality of rib means providing recesses or pockets which serve as barriers to prevent a knife or other sharp object from sliping off the board.

A hand grip is attached to one side of the board to facilitate the handling of the board. The hand grip is used to house a dispenser operable to dispense a gas or aerosol to neutralize an assailant. The dispenser is located in a passage in the hand grip so as to protect and conceal the body of the dispenser. The actuator button and nozzle of the dispenser is exposed. The actuator button is used to release the gas or aerosol in the dispenser for discharge through the nozzle into the atmosphere.

An object of the invention is to provide an apparatus that is useable as a support for accommodating sheet means and as a protection shield. A further object of the invention is to provide a clipboard with a gas or aerosol dispenser. Another object of the invention is to provide a clipboard that has a laminated construction and core that will withstand impact forces of a high velocity projectile, such as a bullet. A further object of the invention is to provide a clipboard with a back surface having a plurality of pockets for confining the movement of an instrument, such as a knife, to a limited area of the back side of the board. Yet a further object of the invention is to provide a clipboard and shield that is lightweight in construction, durable in use, and does not provide the visual impression of a weapon, such as a stick or club. These and further objections and advantages of the invention are embodied in the following detailed description.

IN THE DRAWINGS

DESCRIPTION OF PREFERRED EMBODIMENTS

Figure 1:
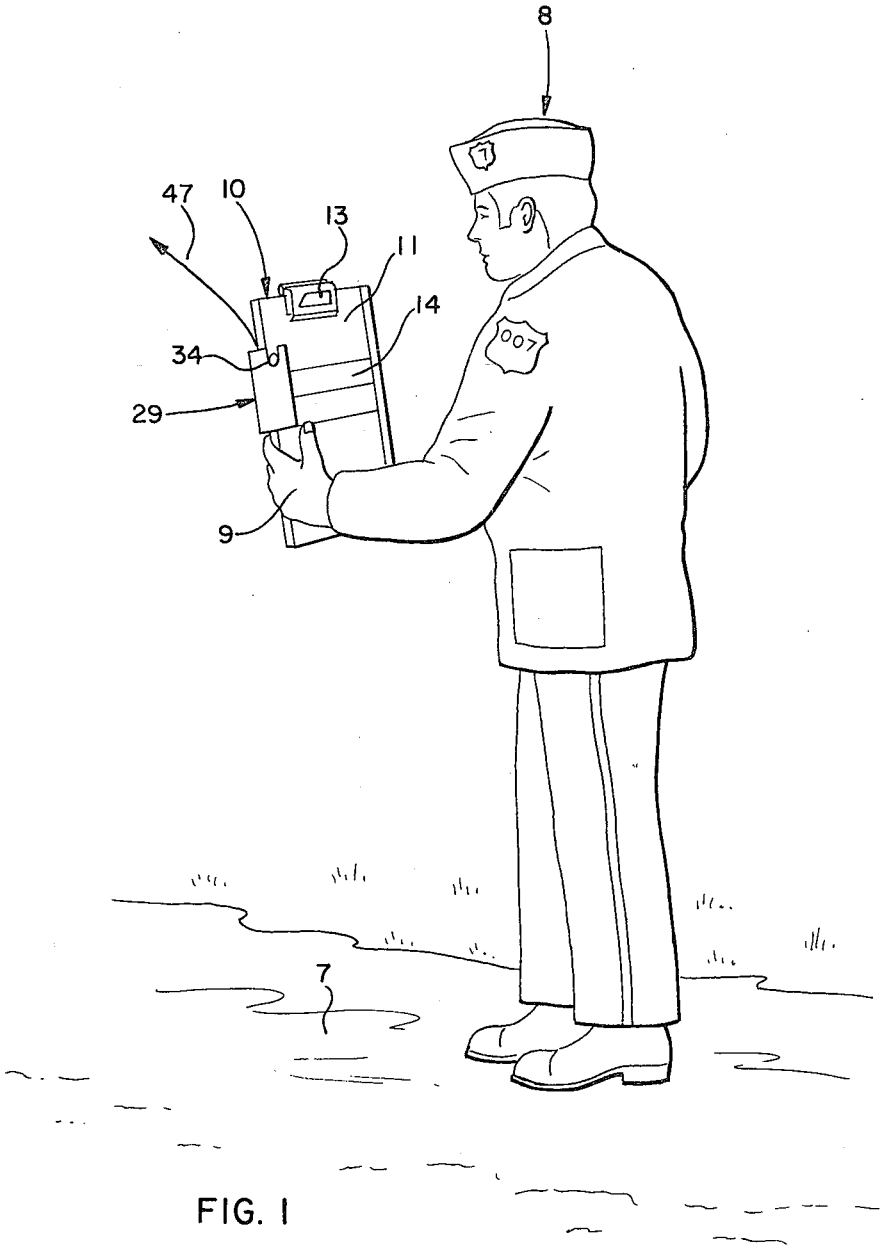
FIG. 1 is a perspective view of a law enforcement officer the board and shield apparatus of the invention.

Referring to FIG. 1, there is shown a law enforcement officer indicated generally at 8 standing on the ground 7 and holding in his left hand 9 a board and shield apparatus of the invention indicated generally at 10. Law enforcement officer 8 can be a policeman, sheriff, deputy, ranger, marshall, military police, FBI persons, and the like. The law enforcement officer 8 is an example of the user of the board and shield apparatus 10. Other persons can use board and shield apparatus 10.

Figure 2:
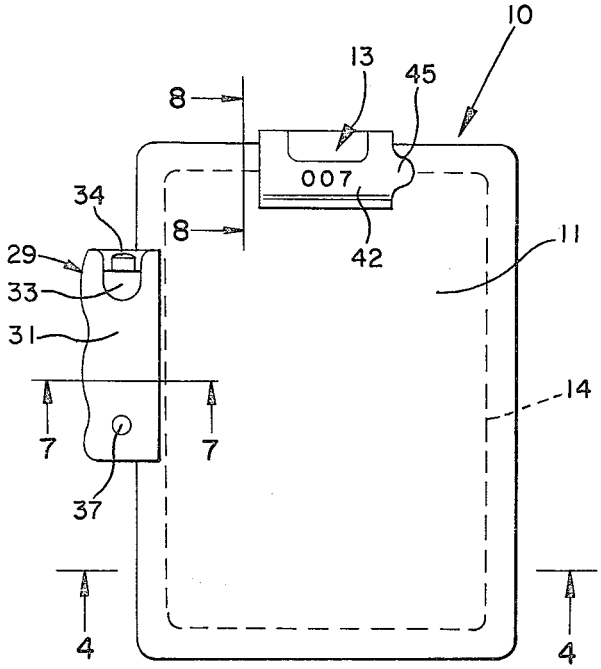
FIG. 2 is a top plan view of the board and shield apparatus of the invention.

Referring to FIG. 2, board and shield apparatus 10 is a generally rectangular shaped board having a flat smooth top surface or side 11 located over a bottom side 12. A hand-operated clip indicated generally at 13 is secured to the top of the apparatus and is engageable with a portion of the top surface 11 to hold a sheet means 14, such as a paper or report and the like, on surface 11.

Figure 6:
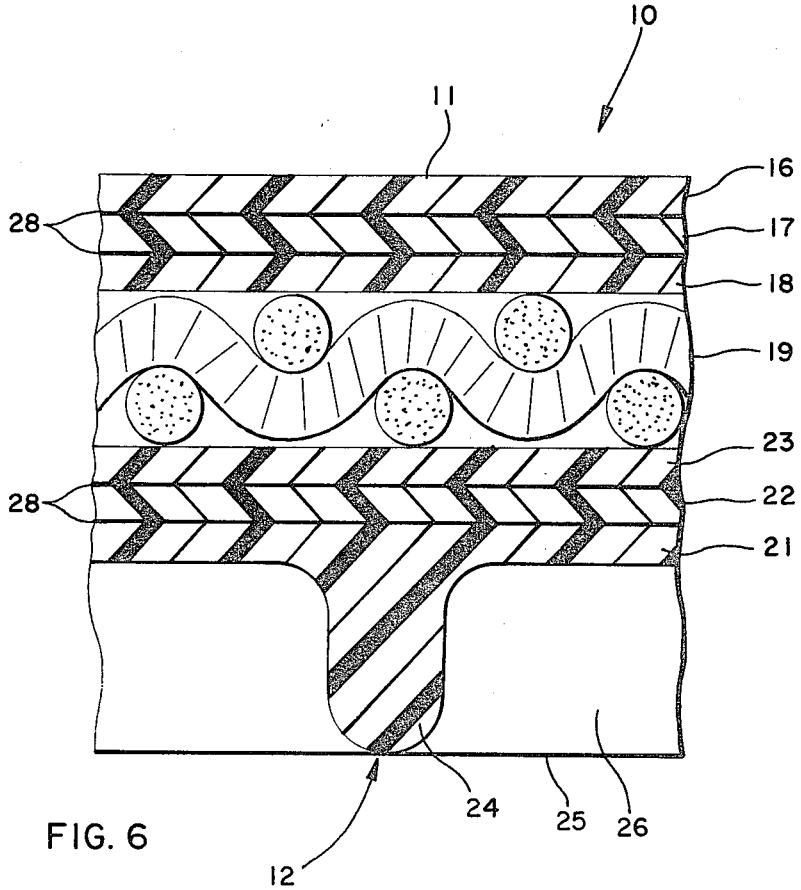
FIG. 6 is an enlarged sectional view taken along the line 6—6 of FIG. 3.

Referring to FIG. 6, apparatus 10 has a top wall comprising a plurality of side-by-side sheet members 16, 17, and 18. Sheet member 16 has the generally flat top surface 11. The adjacent sheet members 16, 17 and 18 are bonded together with an adhesive 28 to provide a laminated structure. The bottom wall 12 of apparatus 10 comprises a plurality of sheet members 21, 22, and 23 that are bonded together with adhesive layers 28 providing a laminated structure. Sheet members 16, 17, 18, 21, 22, and 23 are relatively rigid members. They may be high density polyethylene or a plastic sold under the trade name KYDEX. Other types of structural materials can be used for the sheet members 16–18 and 21–23. A core 19 is located between the sheet members 18 and 23. The core 19 is a woven mat or pad or flexible cords of fibers that have a high impact and tear strength. The fibers can be a plastic, such as KELVAR. Core 19 has a strength characteristic to absorb the force of a rapidly moving projectile, such as a bullet fired from a rifle or hand gun.

Figure 3:
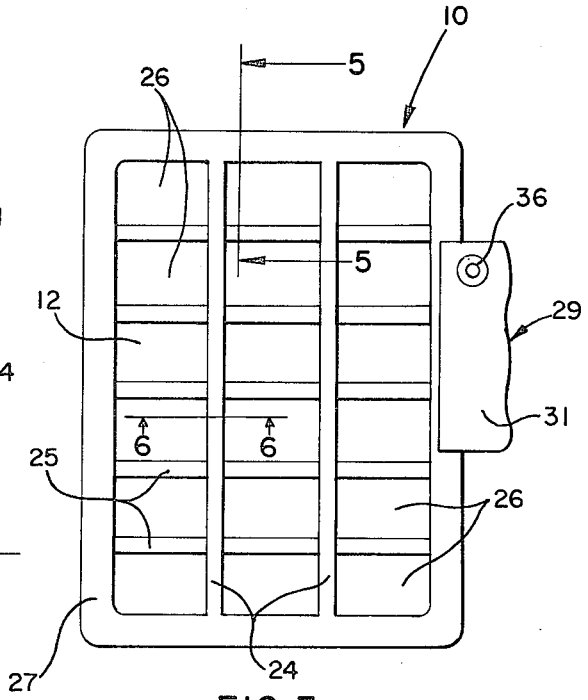
FIG. 3 is a bottom plan view of the board and shield apparatus of the invention.
Figure 4:
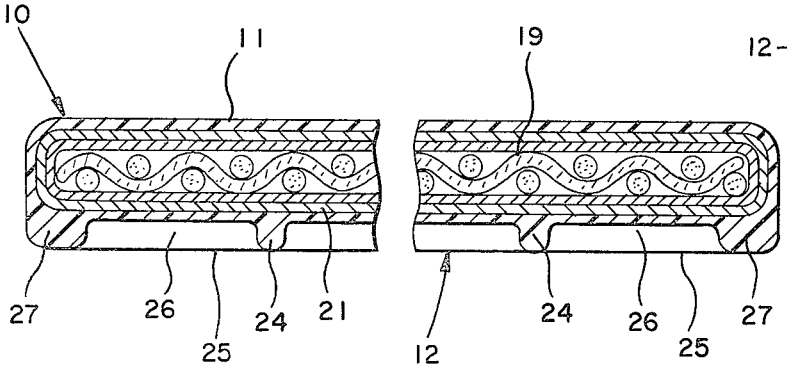
FIG. 4 is an enlarged foreshortened view taken along the line 4—4 of FIG. 2.
Figure 5:
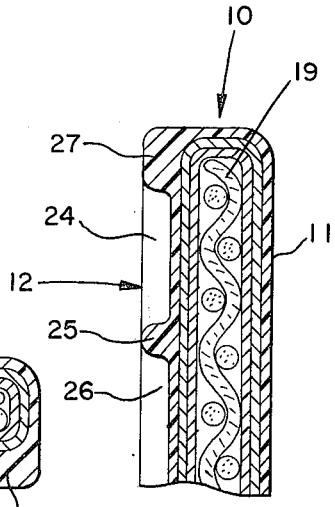
FIG. 5 is an enlarged sectional view taken along the line 5—5 of FIG. 3.

As shown in FIGS. 3 and 6, sheet member 21 has a plurality of longitudinal and transverse ribs 24 and 25 that intersect each other and provide pockets or recesses 26. The ribs 24 and 26 are joined to a conitinuous outer peripheral flange or rib 27 extended around the sides and ends of the sheet member 21.

Figure 7:
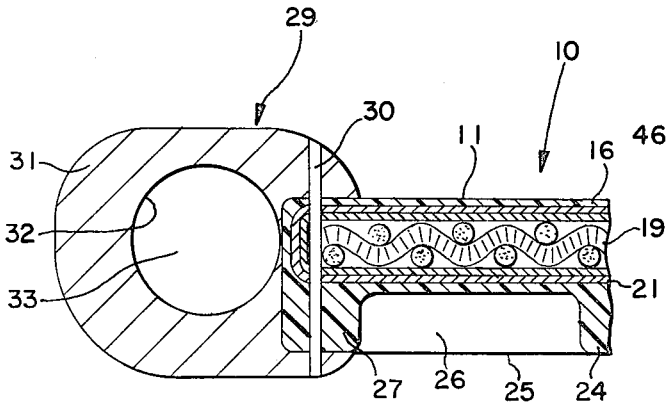
FIG. 7 is an enlarged sectional view taken along the line 7—7 of FIG. 2.
Figure 8:
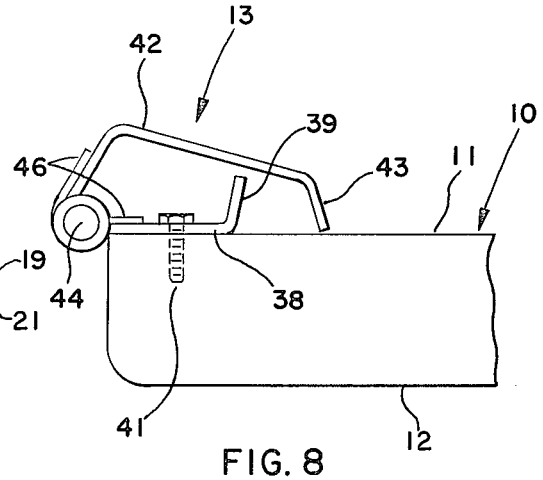
FIG. 8 is a side view of holding clip viewing along the line 8—8 of FIG. 2 with the board shown in outline.

As shown in FIGS. 1, 2, and 7, a hand grip indicated generally at 29 is secured to the left edge of the board with a plurality of fasteners 30, such as pins, screws, or the like. Hand grip 29 can be attached to the opposite side of the board 10 so that the board 10 can be gripped with the right hand. Grip 29 is an elongated member 31 having an outer surface having a convex-concave contour adapted to fit the hand. Grip 29 has a longitudinal passage 32 accommodating a dispenser 33. Dispenser 33 can accommodate a gas or liquid, such as MACE. Dispenser 33 has a top actuator or button 34 that can be depressed to discharge its contents through a nozzle 36 in a direction away from officer 8, as indicated by arrow 47 in FIG. 1. A set screw 37 holds dispenser 33 is assembled relation with grip 29. Set screw 37 can be released whereby the dispenser can be removed from grip 29.

Clip 13 is a hold down structure, as disclosed in U.S. Pat. No. 2,996,774. Clip 13 has a base 38 located on the top edge of flat side 11. Base 38 is joined to an upwardly directed lip 39 which serves as a stop and locator for the top edge of the sheet 14. A plurality of fasteners, such as screws or rivets 41, secure base 38 to sheet member 16. An angular body 42 has a downwardly directed flange 43 engageable with the side 11 below lip 39. The upper end of body 42 cooperates with a pivot 44 which pivotally joins body 42 to base 38. A coil spring 46 surrounds pivot 44 and biases the body 42 in a downward direction thereby holding flange 43 in engagement with the top side 11. Body 42 has an outwardly directed tab or ear 45. The ear 45 provides a means that is readily engaged by the fingers of the hand to lift body 42 thereby releasing the sheet 14. Other lifting structures can be used to move body 42 in an upward direction against the biasing force of spring 46. For example, a handle can be pivoted to the body 42, as shown by handle 34 in U.S. Pat. No. 2,996,774. Other types of clips, as the clip shown in U.S. Pat. No. 1,398,592, can be used with board 10.

In use, the board and shield apparatus normally functions as a conventional clipboard or writing board. The sheet 14 is held by the clip 13 in flat surface engagement with the top side 11 of the apparatus 10. The apparatus 10 is handled with either the left or right hand of the officer 18 to make ouit the routine field and accident reports.

Apparatus 10 functions in emergency situations as a protective shield for the body and face of the officer. The apparatus 10 can be held in front of the officer, as shown in FIG. 1. The board comprising laminated sheet members 16–18 and 21–23 in conjunction with the core 19 has bullet-proof characteristics. A bullet impacting the sheet member 21 may fracture a portion of sheet member 21 and penetrate through the sheet members 22 and 23. Since the sheet members 21, 22, and 23 are separate members, the impact forces are distributed through each member. The projectile or bullet will be lodged in core 19. Core 19 has elastic material having high impact strength so as to dissipate the force of the bullet without penetrating the core.

Apparatus 10 also serves as a protector or shield against a knife or sharp instrument yielding assailant. Pockets 26 surrounded by ribs 24 and 25 serve as barriers to prevent the knife, ice pick, or other sharp objects, from slipping off the back side of the board apparatus and injuring the officer. Apparatus 10 can also be used as a blunt instrument if necessary to maintain law and order.

A hand grip 29 provides a protective storage passage 32 for dispenser 33. The officer 8 if necessary can actuate button 34 and thereby dispense gas or aerosols to neutralize the assailant. Hand grip 29 can be an accessory to the board apparatus 10. In other words, board apparatus 10 can be used without the hand grip 29 or its dispenser 33.

Dispenser 33 can be removed by releasing the lock means or set screw 37. Another dispenser or a flashlight unit can be inserted into passage 32. The flashlight unit may be provided with a right angle head having a lamp or bulb for night use. The top center of board apparatus can be provided with light structure connected to one or more batteries stored in hand grip 29. An actuator button or switch button similar to button 34 associated with the flashlight unit is movable to turn the light on and off and vary the intensity of the light beam. The flashlight unit can be provided with a high intensity light beam useable to deter an assailant. Additional lights could be associated wtih hand grip 29 to illuminate writing surface 11. The electric power for the lights can be one or more batteries stored in passage 32 of hand grip 29 or the battery of a vehicle, as a car or truck. The board apparatus can be used wtih a portable support, as a fold down frame, to locate the board apparatus on a car seat in a position for convenient writing on sheet member 14.

While there has been shown and described the preferred embodiment of the board and shield apparatus of the invention, it is understood that changes in the structure, materials, clip and hand grip may be made by those skilled in the art without departing from the invention. The invention is defined in the following claims.

The embodiments of the invention in which an exclusive property or privilege is claimed are defined as follows:

1. An apparatus useable as a support for accommodating sheet means and as a shield comprising: board means having a core, a plurality of sheet members surrounding the core, one of said sheet members having a generally flat outside surface providing a first side of the board means for accommodating sheet means, a plurality of rib means secured to another of said sheet members providing a second side of the board means, said second side being opposite the first side, means attached to the board means for holding the sheet means on said surface, hand grip means attached to a portion of the board means, and fluid dispensing means mounted on the hand grip means, said dispensing means having fluid discharge means, and actuator means operable to allow fluid to be dispensed into the atmosphere via the fluid discharge means.

2. The apparatus of claim 1 wherein: the sheet members are located side-by-side, and means bonding adjacent sheet members together.

3. The apparatus of claim 1 wherein: said core comprises a mat of woven cords.

4. The apparatus of claim 3 wherein: said cords are high strength plastic.

5. The apparatus of claim 1 wherein: the sheet members are high strength plastic sheet members located in side-by-side relation on opposite sides of the core, and means securing adjacent sheet members together.

6. The apparatus of claim 5 wherein: the means securing adjacent sheet members together is an adhesive.

7. The apparatus of claim 1 wherein: the rib means comprise a plurality of transverse ribs, a plurality of longitudinal ribs, and a peripheral rib extended around the outer edges of said board means, said ribs providing a plurality of pockets in the second side of the board means.

8. The apparatus of claim 1 wherein: the means attached to the board means for holding the sheet means is a clip having a movable member engageable with a portion of the first side of the board means, and biasing means for holding said movable member in engagement with said portion of the first side.

9. The apparatus of claim 1 wherein: said hand grip means has a body with a passage, said fluid dispensing means being located in said passage, said fluid dispensing means including a nozzle, and said actuator means including an actuator button adapted to be moved to allow fluid to be discharged through said nozzle away from the second side of the board means.

10. An apparatus for supporting sheet means and useable as a shield comprising: board means having a core and a plurality of side-by-side high strength plastic sheet members surrounding the core, one of said sheet members having a generally flat outside surface providing a first side of the board means for accommodating sheet means, a plurality of first rib means and second rib means secured to another of said sheet members providing a second side of the board means, said second side being opposite the first side, said first rib means and second rib means being angularly disposed relative to each other, continuous peripheral rib means extending around the outer edges of the board means, said first rib means, second rib means, and peripheral rib means providing a plurality of pockets in the second side of the board means, and means attached to the board means for holding the sheet means on said generally flat surface.

11. The apparatus of claim 10 including: adhesive means bonding the side-by-side sheet members together.

12. The apparatus of claim 11 wherein: the core is a mat of high tear strength woven cords, and means securing adjacent sheet members together.

13. The apparatus of claim 12 wherein: the means securing adjacent sheet members together is an adhesive.

14. The apparatus of claim 10 wherein: the first rib means comprise a plurality of continuous transverse ribs, and the second rib means comprise a plurality of longitudinal ribs, and said peripheral rib means extended around the outer edges of said board means and joined to opposite ends of the transverse and longitudinal ribs.

15. The apparatus of claim 10 including: hand grip means attached to a portion of the board means.

16. An apparatus for supporting sheet means and useable as a shield comprising: board means having a plurality of side-by-side sheet members, one of said sheet members having a generally flat outside surface providing a first side of the board means for accommodating sheet means, a plurality of first rib means and second rib means secured to another of said sheet members providing a second side of the board means, said second side being opposite the first side, said first rib means and second rib means being angularly disposed relative to each other, continuous peripheral rib means extending around the outer edges of the board means, said first rib means, second rib means, and peripheral rib means providing a plurality of pockets in the second side of the board means, means attached to the board means for holding the sheet means on said generally flat surface, hand grip means attached to a portion of the board means, and fluid dispensing means mounted on the hand grip means, said dispensing means having fluid discharge means, and actuator means operable to allow fluid to be dispensed into the atmosphere via the fluid discharge means.

17. The apparatus of claim 16 wherein: said hand grip means has a body with a passage, said fluid dispensing means being located in said passage, said fluid dispensing means including a nozzle and said actuator means including an actuator button adapted to be moved to allow fluid to be discharged to said nozzle away from the second side of the board means.

18. The apparatus for supporting sheet means useable as a shield comprising: board means having a core, a plurality of sheet members surrounding the core, one of said sheet members having a generally flat outside surface providing a first side of the board means for accommodating sheet means, means attached to the board means for holding the sheet means on said surface, hand grip means attached to a portion of the board means, and fluid dispensing means mounted on the hand grip means, said fluid dispensing means having fluid discharge means, and actuator means operable to allow fluid to be dispensed into the atmosphere via the fluid discharge means.

19. The apparatus of claim 18 wherein: the sheet members are located side-by-side, and means bonding adjacent sheet members together.

20. The apparatus of claim 18 wherein: said core comprises a mat of woven cords.

21. The apparatus of claim 20 wherein: said cords are high strength plastic.

22. The apparatus of claim 18 wherein: the sheet members are high strength plastic sheet members located in side-by-side relation on opposite sides of the core, and means securing adjacent sheet members together.

23. The apparatus of claim 22 wherein: the means securing sheet members together is an adhesive.

24. The apparatus of claim 18 wherein: said hand grip means has a body with a passage, said fluid dispensing means being located in said passage, said fluid dispensing means including a nozzle, and said actuator means including an actuator button adapted to be moved to allow fluid to be discharged through said nozzle away from the second side of the board means.

25. An apparatus useable as a protection shield comprising: board means having first and second outside surfaces, said first surface being an outside surface providing a first side of the board means, said second surface located opposite the first surface including a plurality of first rib means and second rib means and continuous peripheral rib means surrounding the first rib means and second rib means, said first rib means and second rib means being angularly disposed relative to each other and providing, with said peripheral rib means, a plurality of pockets in the second side of the board means, said board means includes a core, and high strength plastic sheet members surrounding said core, one of said sheet members having said first surface, and another of said sheet members having said second surface.

26. The apparatus of claim 25 wherein: the sheet members comprise a plurality of side-by-side sheet members, and means securing adjacent sheet members together to another laminated wall, said side-by-side sheet members surrounding said core.

27. The apparatus of claim 26 wherein: said core is a mat of high tear strength woven cords.

28. The apparatus of claim 26 including: hand grip means attached to a portion of the board means.

29. The apparatus of claim 25 wherein: said core is a mat of high tear strength woven cords.

30. The apparatus of claim 25 including: movable clip means attached to the board means for holding sheet means on said first surface.

31. A protection shield apparatus comprising: board means having first and second outside surfaces, a core of high strength woven fabric material, a plurality of side-by-side high density plastic sheet members surrounding the core, and means bonding adjacent sheet members together to provide a laminated wall surrounding the core, said sheet members including an inside sheet member providing a chamber accommodating the core, said inside sheet member engageable with the opposite sides of the core, said sheet members including an outside sheet member having said first and second outside surfaces.

32. The apparatus of claim 31 wherein: said core is a mat of woven cords.

33. The apparatus of claim 32 wherein: said mat has a generally flat shape.

34. The apparatus of claim 32 wherein: said cores have plastic fibers characterized with high impact and tear strength.

35. The apparatus of claim 31 wherein: said sheet members are high density polyethylene sheet members.

36. The apparatus of claim 31 wherein: said means bonding adjacent sheet members together comprise an adhesive bonding the adjacent surfaces of the sheet members together.

37. The apparatus of claim 31 wherein: said board means includes on the second outside surface first rib means and second rib means angularly disposed relative to each other, and continuous peripheral rib means extended around said first and second rib means, said first rib means, second rib means, and peripheral rib means providing a plurality of pockets in the second side of the board means.

38. The apparatus of claim 33 wherein: the first rib means comprise a plurality of continuous transverse ribs, and the second rib means comprise a plurality of longitudinal ribs, and said peripheral rib means extending around the edges of said board means join to opposite ends of the transverse and longitudinal ribs.

* * * * *